US006672703B2

(12) United States Patent
Kohno

(10) Patent No.: US 6,672,703 B2
(45) Date of Patent: Jan. 6, 2004

(54) INKJET PRINTING APPARATUS AND PRINTING SYSTEM

(75) Inventor: Tetsushi Kohno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 09/789,629

(22) Filed: Feb. 22, 2001

(65) Prior Publication Data

US 2001/0033307 A1 Oct. 25, 2001

(30) Foreign Application Priority Data

Feb. 24, 2000 (JP) ..... 2000-048328

(51) Int. Cl.[7] ..... B41J 2/165
(52) U.S. Cl. ..... 347/23
(58) Field of Search ..... 347/23, 29, 30, 347/7, 14, 19, 86; 358/296, 401, 468, 502

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,625,384 A | * | 4/1997 | Numata et al. | 347/23 |
| 5,949,447 A | * | 9/1999 | Arai et al. | 347/23 |
| 6,056,389 A | | 5/2000 | Nohata et al. | 347/19 |
| 6,174,042 B1 | * | 1/2001 | Kobayashi et al. | 347/23 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 5-96747 | 4/1993 |
| JP | 11-192728 | 7/1999 |
| JP | 2000-190517 | 7/2000 |

* cited by examiner

*Primary Examiner*—Shih-wen Hsieh
(74) *Attorney, Agent, or Firm*—Fitzpatrick, Cella, Harper & Scinto

(57) ABSTRACT

In an inkjet printer having device for executing recovery processing by ink suction to make the ink ejection state of a printing head favorable, increase in ink consumption due to recovery processing is suppressed properly while maintaining ejection quality. When it is judged that recovery processing is necessary due to exchange of a head or an ink tank, this information is stored in a RAM and an EEPROM. Only before execution of print, recovery processing is executed when it is determined that the recovery processing is necessary based on the information. At the execution, the information is cleared to a recovery unnecessary state. As the information is held in the EEPROM, necessity of the recovery processing after power supply ON is determined based on a recovery processing execution state before the power supply was turned off. Therefore, suction recovery processing is executed without waste at a proper timing.

17 Claims, 10 Drawing Sheets

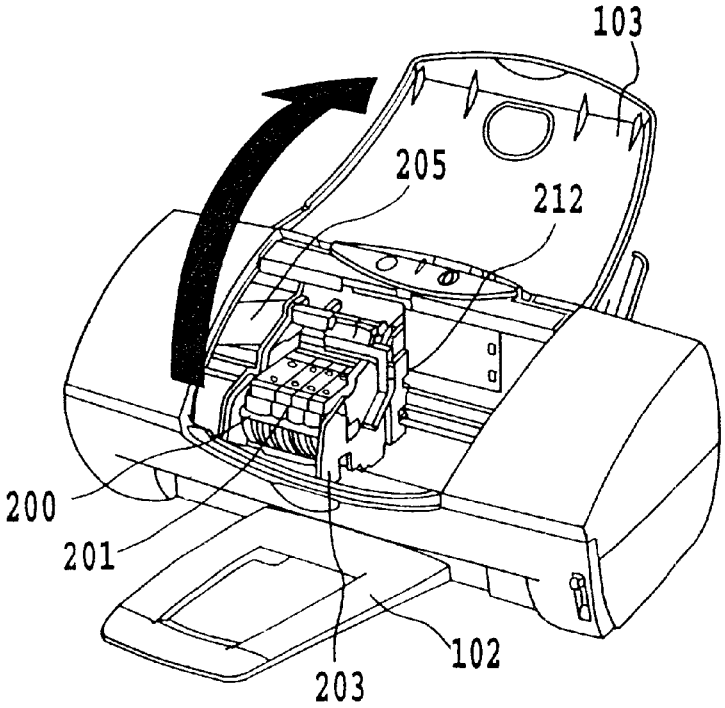
FIG.2A
FIG.2B-1
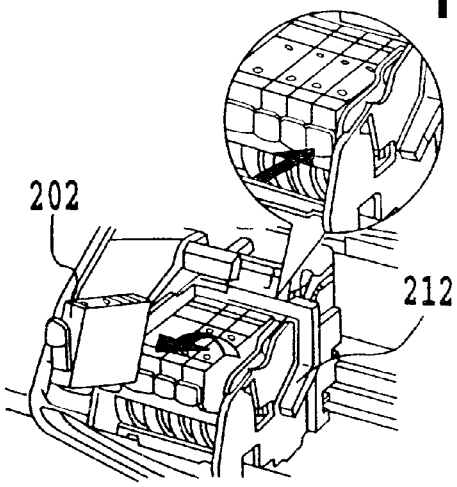
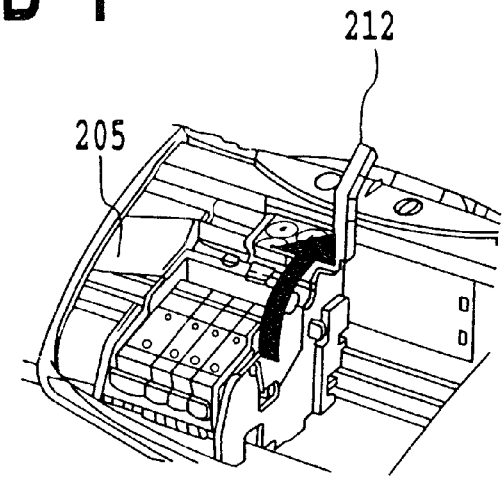
FIG.2B
FIG.2C

INKJET PRINTING APPARATUS AND PRINTING SYSTEM

This application is based on patent application Ser. No. 2000-48328 filed Feb. 24, 2000 in Japan, the content of which is incorporated hereinto by reference.

BACKGROUND OF THE INVENTION

1. Field of the Invention

The present invention relates to an inkjet printing apparatus for printing on a printing medium by using a printing head for ejecting ink and is particularly squitable to be applied to maintenance of the printing head.

2. Description of the Related Art

There are inkjet printing apparatuses in which printing heads can be exchanged appropriately according to the purpose of print such as print of monochrome image, color image, binary image, half-tone image or photo-tone image and so on, in addition to exchange when the life of printing head (inkjet head) ends. Also, they are so constructed that printing agent can be replenished, e.g. by means of exchange of ink tank, when ink as printing agent runs out.

When the printing head is exchanged, ejection failure or non-ejection might be caused by clogging of an ink ejection opening depending on the storage condition of the printing head. Also, when the ink tank is exchanged, ejection failure or non-ejection might occur because a liquid chamber in the printing head or a liquid passage from the liquid chamber to the ejection opening is not fully filled with ink, or air is mixed in the passage from the ink tank to the liquid chamber of the printing head.

In general, in the inkjet printing apparatus, recovery processing means for forcedly discharging ink through the ink ejection opening is provided in order to eliminate the cause of ejection failure or non-ejection and to maintain the ejection performance favorable. The recovery processing means comprises, for example, a cap member for capping a face on which ejection openings are formed of the inkjet head (the face will be referred as 'the ejection opening forming face', hereinafter), suction means for suctioning the inside of the cap and a member for wiping the ejection opening forming face.

In conventional inkjet printing apparatuses, when it is determined that the printing head or the ink tank should be exchanged, the recovery operation is executed each time using the recovery processing means.

The recovery processing for forcedly discharging ink through the inkjet head by such suction or the like is the processing indispensable for eliminating ejection failure or the like of the inkjet head due to clogging of the ink ejection opening and for maintaining ejection performance. However, it encompasses a problem that ink consumption will rise due to recovery processing and therefore, it is desirable that the processing is preferably kept within the necessary and sufficient range.

However, in the conventional inkjet printing apparatus, the recovery processing is executed in the condition not accompanied actual print, and ink is wasted in some cases. For example, it occurs in the case that a printing head not suitable for the print purpose is attached. Also, in a printing apparatus which judges that replacement of an ink tank is executed by detecting an opening operation of a front cover and so on provided for the replacement or a replacement switch pressing operation, recovery processing is executed each judgement, and ink would be wasted by recovery operation more than necessary.

SUMMARY OF THE INVENTION

Thus, the object of the present invention is to effectively suppress increase in ink consumption by properly judging necessity of recovery processing while maintaining ejection quality of the inkjet head.

In a first aspect of the present invention, there is provided an inkjet printing apparatus for printing on a printing medium by using a printing head for ejecting ink, comprising:

means for executing recovery processing for making ink ejection state of the ink favorable;

means for storing information showing whether the recovery processing is necessary or not; and control means for judging necessity of the recovery processing based on the contents of the storing means prior to start of print operation and for executing the recovery processing when it is judged that the recovery processing is necessary.

In a second aspect of the present invention, there is provided a printing system comprising a printing apparatus for performing printing on a printing medium by using a printing head and an image data supplying apparatus for supplying an image data to be printed to the printing apparatus, the apparatus having means for executing recovery processing for making ink ejection state of the ink favorable, the system comprising:

means for storing information showing whether the recovery processing is necessary or not; and control means for judging necessity of the recovery processing based on the contents of the storing means prior to start of print operation and for executing the recovery processing when it is judged that the recovery processing is necessary.

According to the present invention, particularly its one preferred embodiment, which will be described later, an exchange mode of printing head/ink tank (ink storing member) is provided as well as exchange detecting means, a temporary memory (storage means) and a non-volatile memory (holding means) for storing necessity of a suction recovery processing judged based on the detected results, and suction recovery executing means (control means) for determining the necessity of suction recovery of the printing head based on the memory contents before print and for executing suction recovery if necessary. Further, there is provided a function to write predetermined information in the above memory and the non-volatile memory after execution of the suction recovery.

When it is judged that suction recovery of the printing head is necessary due to exchange of the printing head or the ink tank, the information is stored in the temporary memory and the non-volatile memory mounted on the printing apparatus. Only before execution of the print operation, it is judged whether the suction recovery is necessary or not, if an affirmative judgment is made, the suction recovery operation is executed. At execution of the suction recovery, the above information is cleared. Also, the above information is stored in the non-volatile memory and its contents are retained even after the apparatus power source (primary power supply) is off, and necessity of maintenance processing after the power supply is turned on can be judged based on the maintenance state of the printing head before the power supply was turned off. By them, increase in ink consumption due to recovery processing of the inkjet head is effectively suppressed while maintaining ejection quality of the printing head.

Incidentally, in this specification, a word "image" means the concept covering characters such as letters, numbers, symbols, etc. as well as images of patterns, pictures, photos, etc. in a narrow sense and also includes mixture of them.

A word "print" refers to not only forming significant information, such as characters and figures, but also forming images, designs or patterns on printing medium and processing media, whether the information is significant or insignificant or whether it is visible so as to be perceived by humans.

The term "printing medium" include not only paper used in common printing apparatus, but cloth, plastic films, metal plates, glass, ceramics, wood, leather or any other material that can receive ink.

Further, the word "ink" should be interpreted in its wide sense as with the word "print" and refers to liquid that is applied to the printing medium to form images, designs or patterns, process the printing medium or process ink.

The above and other objects, effects, features and advantages of the present invention will become more apparent from the following description of embodiments thereof taken in conjunction with the accompanying drawings.

BRIEF DESCRIPTION OF THE DRAWINGS

FIG. 2A is a perspective view showing the state where a part of the inside of the apparatus is exposed by opening a front cover of the apparatus in FIG. 1, FIG. 2B is an explanatory view for explaining exchange of an ink tank in the exposed state, FIG. 2B-1 is an enlarged view showing operation of a removal lever on the ink tank, and FIG. 2C is an explanatory view for explaining exchange of a head cartridge;

FIG. 9 is a flowchart showing an example of processing procedures executed when the primary power supply (AC power source) is turned on.

DETAILED DESCRIPTION OF THE PREFERRED EMBODIMENTS

Figure 1:
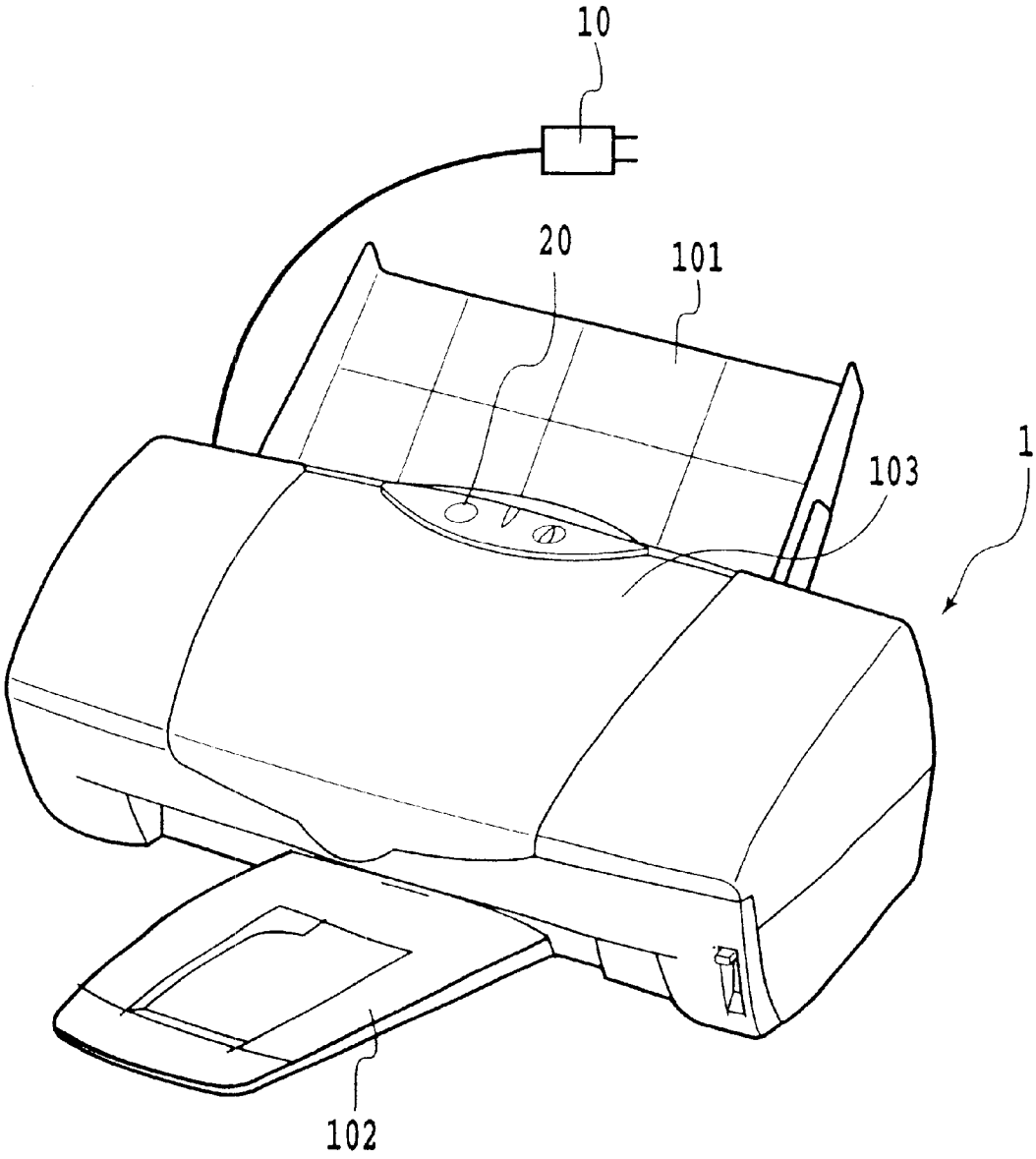
FIG. 1 is a perspective view showing a configuration of an inkjet printing apparatus as an example of the printing apparatus to which the present invention is preferably embodied or applied.

Hereafter, the present invention will be described in detail referring to the drawings.

(An Example of a Printing Apparatus)

FIG. 1 is a perspective view showing a configuration of an inkjet printing apparatus as an example of the printing apparatus to which the present invention is preferably embodied or applied.

In FIG. 1, a printing apparatus shown by the reference numeral 1 is provided with a primary power-turn-on part 10 to bring a state where electric power is physically supplied to the apparatus (hardware-power-on state) and a secondary power-turn-on switch 20 to bring the printing apparatus into a state in which functions can be executable (software-power-on state). Reference numeral 101 denotes a paper feed tray on which printing media to be used for print processing are piled, while reference numeral 102 denotes a paper eject tray for piling printing media after printing. Denoted 103 is a front cover for opening the apparatus.

In the example shown in FIG. 1, the primary power power-turn-on part 10 serves as a connection part for receiving supply of electric power and brings the apparatus to the state where power is supplied from the outside by being connected to a power supply source such as a home power supply outside the apparatus. Also, the switch 20 shown in FIG. 1 switches between the state where the apparatus is operable and the state where the apparatus is not operable, during power is supplied to the apparatus by the primary power-turn-on part 10. Thus, the printing apparatus shown in FIG. 1 is brought to the hardware-power-on state by being connected to a power source such as home power supply and is switched to the software-power-on or -off state by operating the switch 20.

FIGS. 2A to 2C show a state where a part of the inside of the apparatus is exposed by opening the front cover 103. The front cover 103 may take any form which can expose a necessary part of the apparatus for ink tank exchange or other jobs. For instance, the front cover 103 may be rotatably attached to the body by a hinge or the like in the direction of the arrow in FIG. 2A or may be completely separable from the body of the printing apparatus 1.

In these figures, reference numeral 201 denotes a head cartridge. Denoted 203 is a carriage having a cartridge holder as a member for removably holding the head cartridge 201. Denoted 212 is a lever to fix the head cartridge 201 to the carriage 203. When the lever 212 is manipulated after the head cartridge 201 is attached to the carriage 203, the head cartridge 201 is pressed onto carriage 203. By this pressing, the head cartridge 201 is positioned and an electric contact on the head cartridge 201 is in contact with a required electric contact provided at the carriage 203 for signal transmission. Denoted 205 is a flexible cable for transmitting electric signals to the carriage 203.

The head cartridge 201 used in this example holds an ejection portion as a main body of an inkjet head and also removably holds an ink tank 202 for storing ink to be supplied to the ejection portion. That is, when the residual quantity of the ink tank becomes runs short or zero, only the ink tank can be separately exchanged.

In the printing apparatus of this preferred embodiment, an ink tank or a head cartridge is exchanged in a head cartridge/ink tank exchange mode set by opening the front cover 103. That is, when the front cover 103 is opened, the carriage 203 removably holding the head cartridge 201 is moved to the exchange position shown in FIG. 2A, where the ink tank 202 (FIG. 2B) or the head cartridge 201 (FIG. 2C) can be exchanged.

In the case that the ink tank 202 is exchanged, when the front cover 103 is closed and the head cartridge/ink tank exchange mode is to be finished, the exchange of the ink tank 202 may be judged by reading the ink storage state in the ink tank by using, for example, an optical sensor and comparing the ink storage states when the cover is opened and closed. Also, the exchange of the head cartridge may be judged based upon a signal level at the electric contact parts of the carriage 203 and the head cartridge 201.

Figure 3:
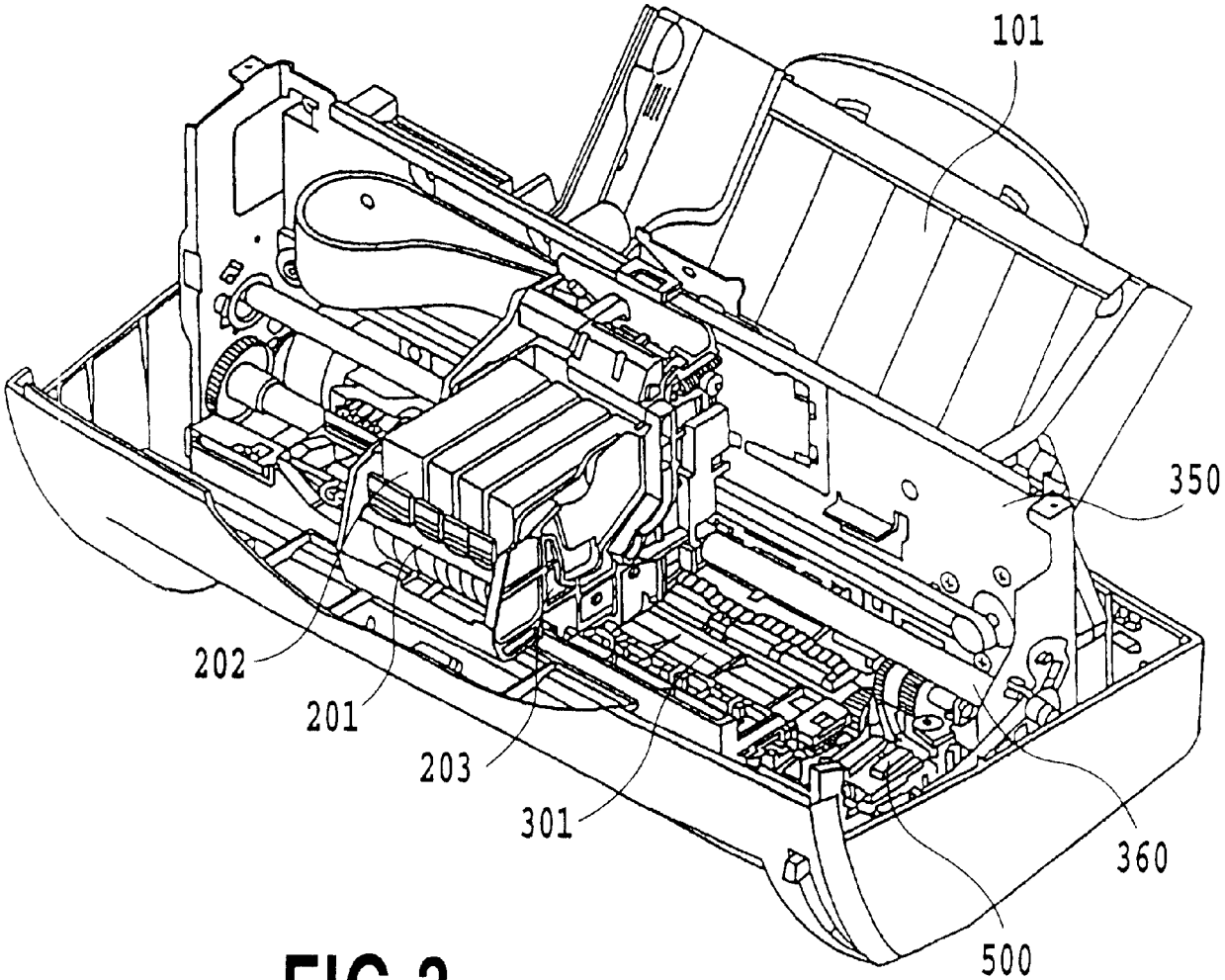
FIG. 3 is a perspective view showing the state where the whole inside of the apparatus is exposed by removing the entire upper cover of the apparatus in FIG. 1.

FIG. 3 shows a state where the entire upper cover of the apparatus is removed and the whole inside of the apparatus is exposed.

A sheet-like printing medium set on the paper feed tray 101 is fed by a feed roller and conveyed (sub-scan) over a platen 301 by a conveyer roller. The carriage 203 is supported in capable of movement (main scan) over a scan rail 360, and a printing is executed by driving the inkjet head to eject ink during the process of movement.

Denoted 500 is a recovery system and comprises, for example, a cap member for capping an ejection opening forming face of the inkjet head, suction means such as a pump for suctioning inside this cap, and a member for wiping the face ejection opening forming. When a driving source for driving these members are used also as a driving source (e.g., motor) for conveying a printing medium, an appropriate driving switching unit may be provided at the recovery system 500. Denoted 350 is a chassis for supporting each of the above members.

The head cartridge 200 in this example is to hold four ejection portions in total, each of which corresponds to monochrome ink (black, for example) or color ink (cyan, magenta and yellow) and permits each of the ink tanks 202 storing ink to be supplied to each of the ejection portions to attach/remove. However, the form of the head cartridge and the form of attachment are not limited to the examples shown in FIG. 3. That is, besides this example in which each corresponds to a single-color ink, those integrally supporting an ink tank corresponding to plural ink types with different tone (color, density, etc.) and ejection portion may be used. A plurality of head cartridges corresponding to a single-color or plural-colors may be provided corresponding to different print density. Also, the head cartridge corresponding to the purpose may be selectively attached to the carriage 203 according to the object of the print such as binary images, half tone images or photo tone images.

Moreover, the ink ejection portion may have a construction inseparable from the ink tank, or may be supplied with ink through a tube or the like from the ink tank provided at a separate location of the apparatus.

Also, each of the ejection portions may have a number of ink ejection openings arranged thereon, liquid passages each of which communicates to each of the ink ejection openings and electrothermal transducers (ejection heaters) each of which is provided at the liquid passage to generate thermal energy according to electricity for causing film boiling in the ink as an energy to be used for ejecting ink.

(An Example of a Control System of the Printing Apparatus)

Figure 4:
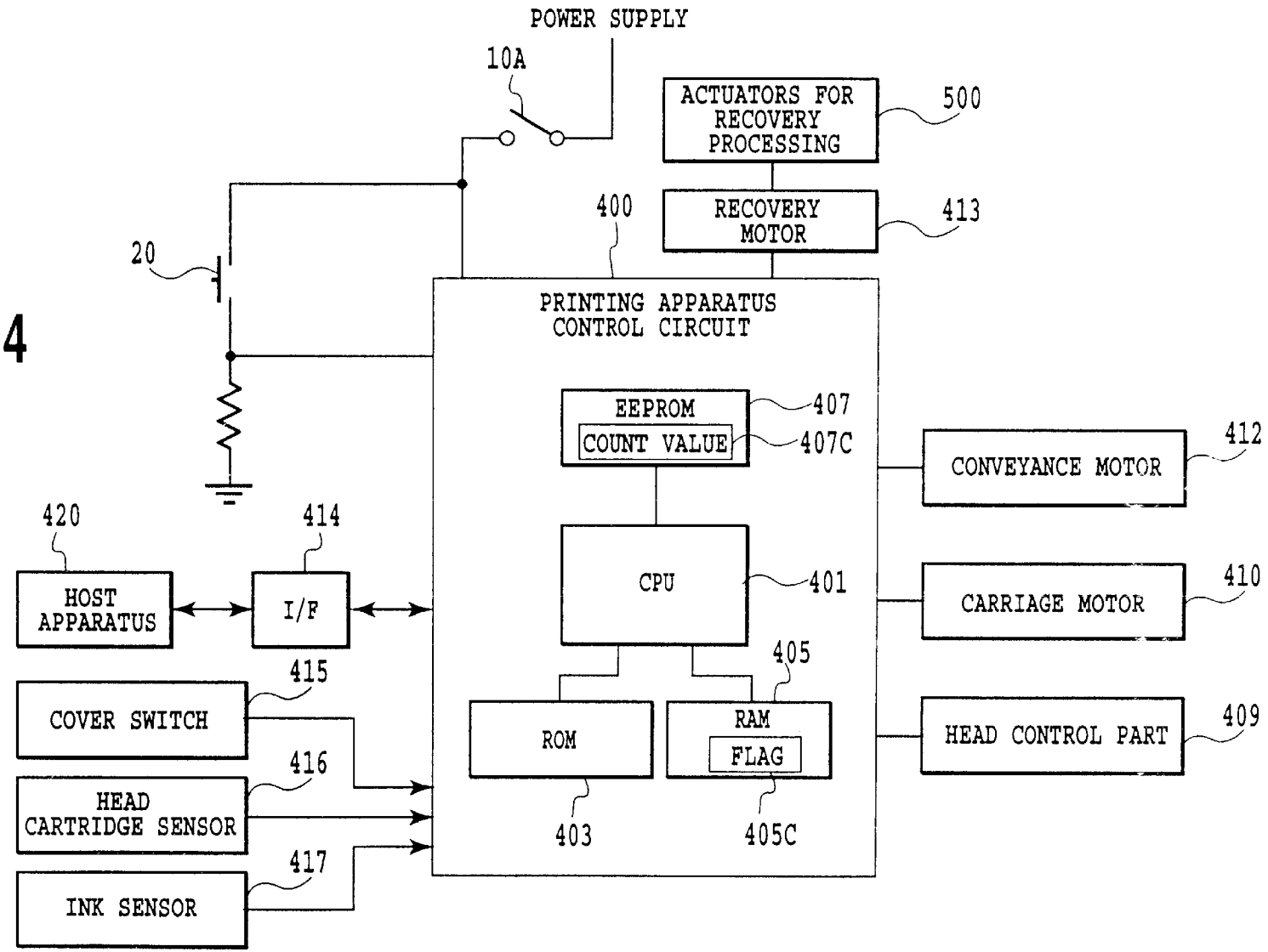
FIG. 4 is a block diagram showing a configuration of a control system of the printing apparatus shown in FIGS. 1 to 3.

FIG. 4 is a block diagram showing a schematic constructional example of a control system of the above-mentioned printing apparatus.

The printing apparatus of this embodiment has two power supply layers, one of which is a primary power supply part (including a primary power switch 10A interposed between power lines) for supplying electric power to a control circuit 400 of the printing apparatus to function the control circuit and the other is a secondary power switch 20 to bring the state where the printing apparatus is enabled to operate.

The control circuit 400 has in general CPU 401, ROM 403, RAM 405 and EEPROM 407. Here, the CPU 401 may take the form of a microcomputer. The CPU 401 generates print data in the printing apparatus, analyzes various commands, performs various settings, and controls main scan and sub-scan, etc. Further, the CPU 401 executes processing procedures which will be described later referring to FIGS. 6 to 9. The ROM 403 stores programs corresponding to these processing procedures, required tables and other fixed data.

The RAM 405 has an area to be used for expanding print data, an area for temporarily storing various setting information, an area to be used for processing of print data, when necessary, and an area for temporarily storing data and commands put into an interface (I/F) 104 and data and commands put out of an interface 414. In this example, particularly, the RAM 405 is provided with a flag area 405*c* (recovery-processing-judgement flag) for presenting information showing whether the suction recovery processing is necessary or not. The EEPROM 407 is a non-volatile memory having an area 407A for holding the count value of the counter area 405A of the RAM 405 even when the primary power supply is OFF.

Reference numeral 409 denotes a head control part for driving ejection heaters of the inkjet head according to the print data and so on. Denoted 410 is a carriage motor as a driving source for reciprocally moving the carriage 203 in the main-scan direction. Denoted 411 is a conveyer motor as a driving source for conveying the printing medium in the sub-scan direction. Denoted 413 is a recovery motor as a driving source for actuators (suction pump, cap movement mechanism, blade movement mechanism, etc.) of a recovery system 500. These are operated under the control of the CPU 401. When it is judged that the recovery processing is necessary, the driving force of the motor 413 is transmitted to the actuators of the recovery system 500 for operation, and the suction recovery operation of the inkjet head is executed.

Denoted 420 is a host apparatus connected through the interface 414. The host apparatus 420 may be a computer for generating data of images to be printed by the printing apparatus and for processing and editing the data, etc. This host apparatus 120 may take the form of a digital camera.

Denoted 415 is a cover switch and gives information on detection of opening/closing state of the front cover 103 to the CPU 401 in the control circuit 400. The cover switch 415 may be a contact type switch having an actuator which is engaged with the front cover 103 and is displaced or deformed in accordance with opening/closing operation of the cover 103. Alternatively, any other appropriate switches such as non-contact switch for magnetically or optically detecting opening/closing state may be used. Denoted 416 is a sensor for detecting whether the head cartridge 201 is attached or not. The sensor 416 may be a switch or the like, which is closed according to the attachment of the head cartridge 201.

Denoted 417 is an ink sensor for detecting the ink state in the ink tank 202 attached to the head cartridge 201. This ink sensor 417 may take various forms in relation to construction of the ink tank 202.

Figure 5A:
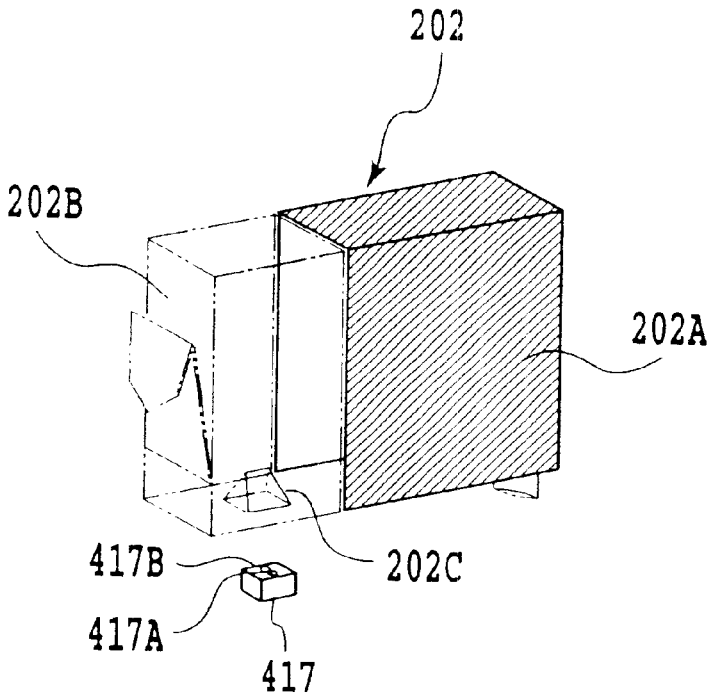
FIGS. 5A to 5C are explanatory views showing examples of a construction and operations of an ink information detection system including an ink sensor in FIG. 4.
Figure 5B:
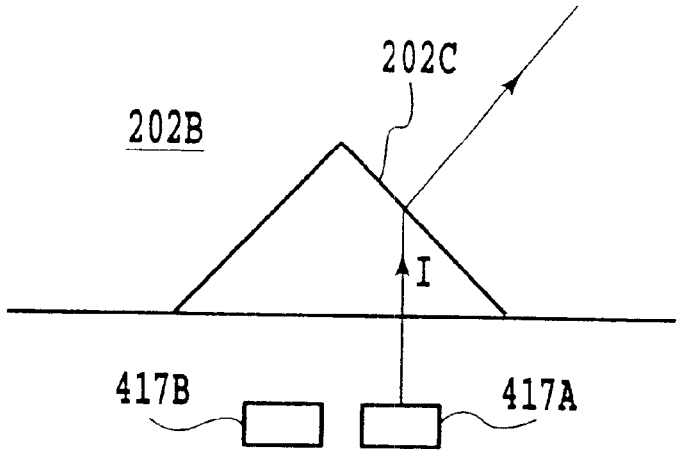
Figure 5C:
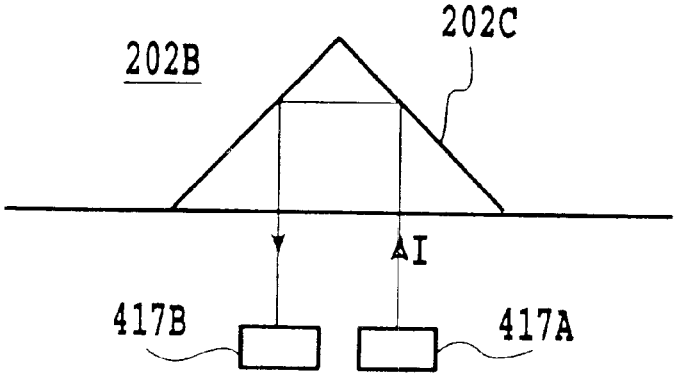

FIGS. 5A to 5C show constructional and operational examples of the ink information detection system including the ink sensor 417.

In FIG. 5A, the ink tank 202 in this example has a portion 202A (absorber portion) which houses an absorber such as sponge for absorbing and holding ink and a portion 202B (oozing ink holding portion) which communicates to the inkjet head and stores ink oozed from the absorber portion 202A according to the ink ejection operation of the inkjet head and a refill action. At the bottom of the oozing ink holding portion 202B, that is, a portion opposing the carriage 203 through an appropriate opening or the like provided at the head cartridge 201, alternatively, a portion opposing a predetermined portion of the apparatus through the opening of the head cartridge 201 and an opening or the like provided at the carriage 203, a prism-like detective portion 202C detected by the ink sensor 417 is provided. The detective portion 202C has an angled portion having substantially the same refraction factor as the ink to be stored. A shape, an angle and so on of the angled potion are appropriately determined so that a reflected light is properly returned to a light receiving portion, which will be described later, when ink is not stored.

At the carriage 203 opposing the detective portion 202C or the predetermined portion of the apparatus, the ink sensor 417 is mounted with a light emitting portion 417A and a light receiving portion 417B arranged with a predetermined interval.

In the construction of such the ink information detection system, when the ink tank is exchanged, the front cover 103 is closed and the head cartridge/ink tank exchange mode is finished, the exchange of the ink tank 202 is judged by reading the state of the oozing ink holding portion 202B of the ink tank 202 by using the ink sensor 417.

That is, first, in a state where there remains no ink in the oozing ink holding portion 202B, a light emitted from the light emitting portion 417A advances through the oozing ink holding portion 202B as shown in FIG. 5B, and as it is not returned to the light receiving portion 417B, it can detect that there is no ink remaining in the ink tank 202. Further, by notifying it using an appropriate means, the user can be prompted to exchange the ink tank.

When the user responds to this, opens the front cover 103 and exchanges the ink tank, as ink remains in the oozing ink holding portion 202B if ink is sufficiently stored in the newly exchanged ink tank, the light emitted from the light emitting portion 417A is returned from the detective portion 202C to the light receiving portion 417B as shown in FIG. 5C. Thus, by verifying output from the light receiving portion 417B when exiting from the exchange mode, exchange of the ink tank 202 is judged.

In the control system in the above construction, when it is judged that the front cover 103 is opened based on the output signal of the cover switch 415, the apparatus moves to the head cartridge/ink tank exchange mode.

In this exchange mode, when there is a change in the output of the head cartridge sensor 416, it is judged that the head cartridge 201 has been exchanged. Then the determination information that the recovery processing is necessary is stored in the flag area 405C in the RAM 405 as well as in the EEPROM 407. Also, when the front cover 103 is closed and the head cartridge/ink tank exchange mode is finished, it is judged that ink tank exchange is has been performed or not based on a change in output of the ink sensor 417 between the cover opened time and the cover closed time. If it is judged that the ink tank has been exchanged, the determination information that the recovery processing is necessary is stored in the flag area 405C in the RAM 405 as well as in the EEPROM 407.

When a print command is received from the host apparatus 420 or the like, the information on whether recovery is necessary or not is checked before paper feed, and if it is determined as necessary, the recovery processing is executed. When the recovery processing is executed, the information for judging necessity of recovery in the RAM 405 and the EEPROM 407 are cleared.

Judgement on exchange of the head cartridge or ink tank is made based on the output of each sensor as well as on a period of time that the apparatus is set to the head cartridge/ink tank exchange mode.

(Control Procedure)

Referring to FIGS. 6 to 9, a detailed processing example of the printing apparatus according to this preferred embodiment will be described.

Figure 6:
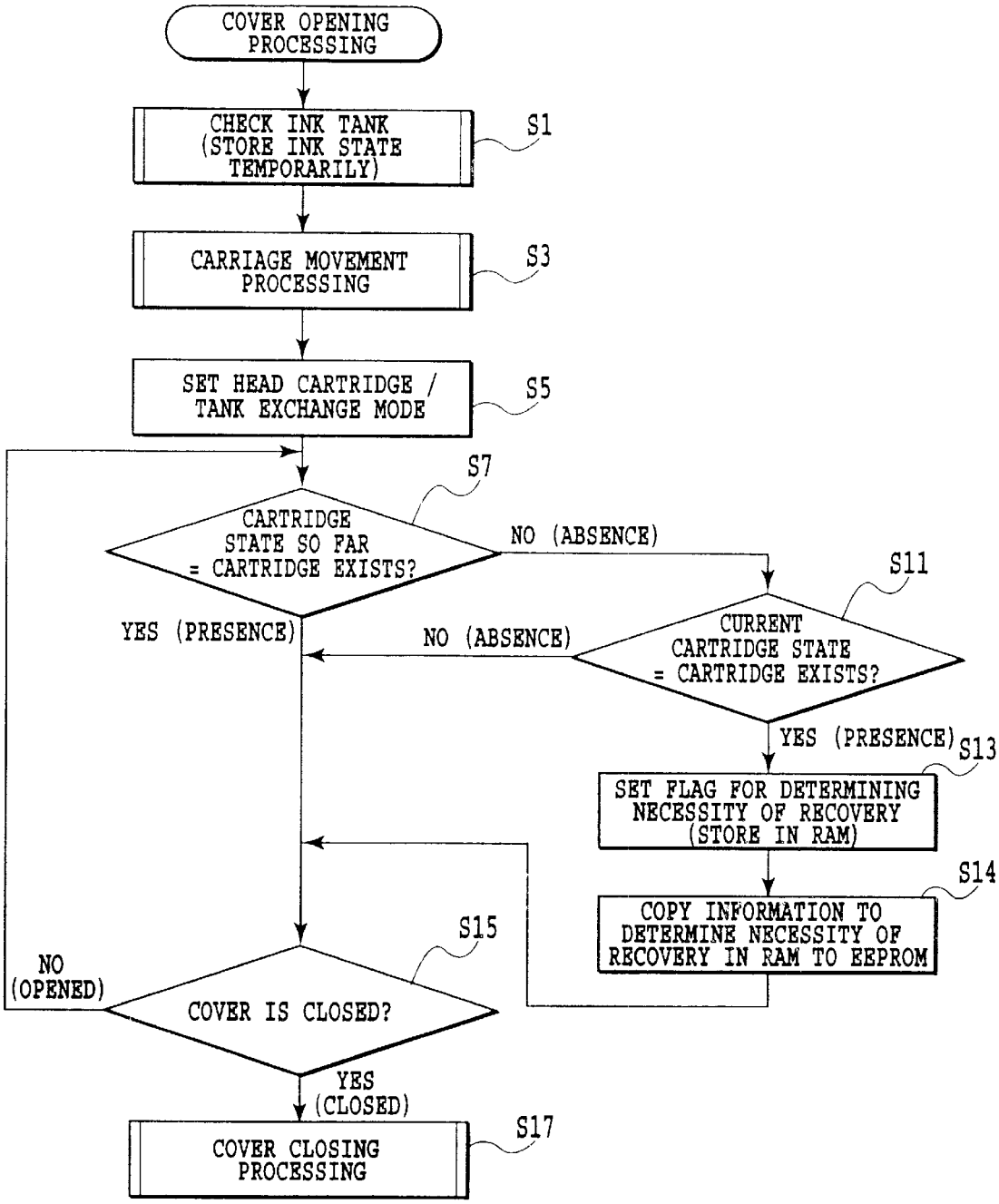
FIG. 6 is a flowchart showing an example of cover opening processing procedures activated when the front cover shown in FIGS. 1 and 2 is opened.

FIG. 6 is a flowchart showing an example of cover opening processing procedure. This procedure is activated in response to the notice that there remains no ink or when the user wishes exchange of the head cartridge and opens the front cover 103.

When the front cover 103 is opened, first, information on a state of ink in the oozing ink holding portion 202B of the ink tank 202 is temporarily stored (Step S1). Next, the carriage 203 is moved to the head cartridge/ink tank exchange position (Step S3) and the apparatus is set to the head cartridge/ink tank exchange mode by means of internal control (Step S5).

Then, till it is judged that the front cover 103 is closed (Step S15), a state of the head cartridge 201 is checked based on the output of the sensor 416 (Step S7, S11). When removal of the head cartridge 201 and attachment of new one are detected, that is, the current cartridge detected state by the sensor 416 is changed from "absence" to "presence", the flag 407C for determining necessity of recovery in the RAM 405 is set (Step S13), and this information is also stored in the EEPROM 407 (Step S14).

When it is detected that the front cover 103 is closed, the program moves to the cover closing processing (Step S17). Here, if the cover closing is judged without detecting exchange of the head cartridge 201, that is, if the user closed the front cover 103 without exchanging the head cartridge 201, or with exchanging the ink tank only, the information to determine necessity of recovery in the RAM 405 is not renewed by the processing of this procedure but remained to the previous state. Also, in the case that exchange of the head cartridge 201 is detected and the information to determine necessity of recovery is set in the RAM 405 and the EEPROM 407, the next judgement of cover closing will be waited for.

When the front cover 103 is closed without attaching the head cartridge 201, the user may be notified in the subsequent processing and prompted for attachment.

Figure 7:
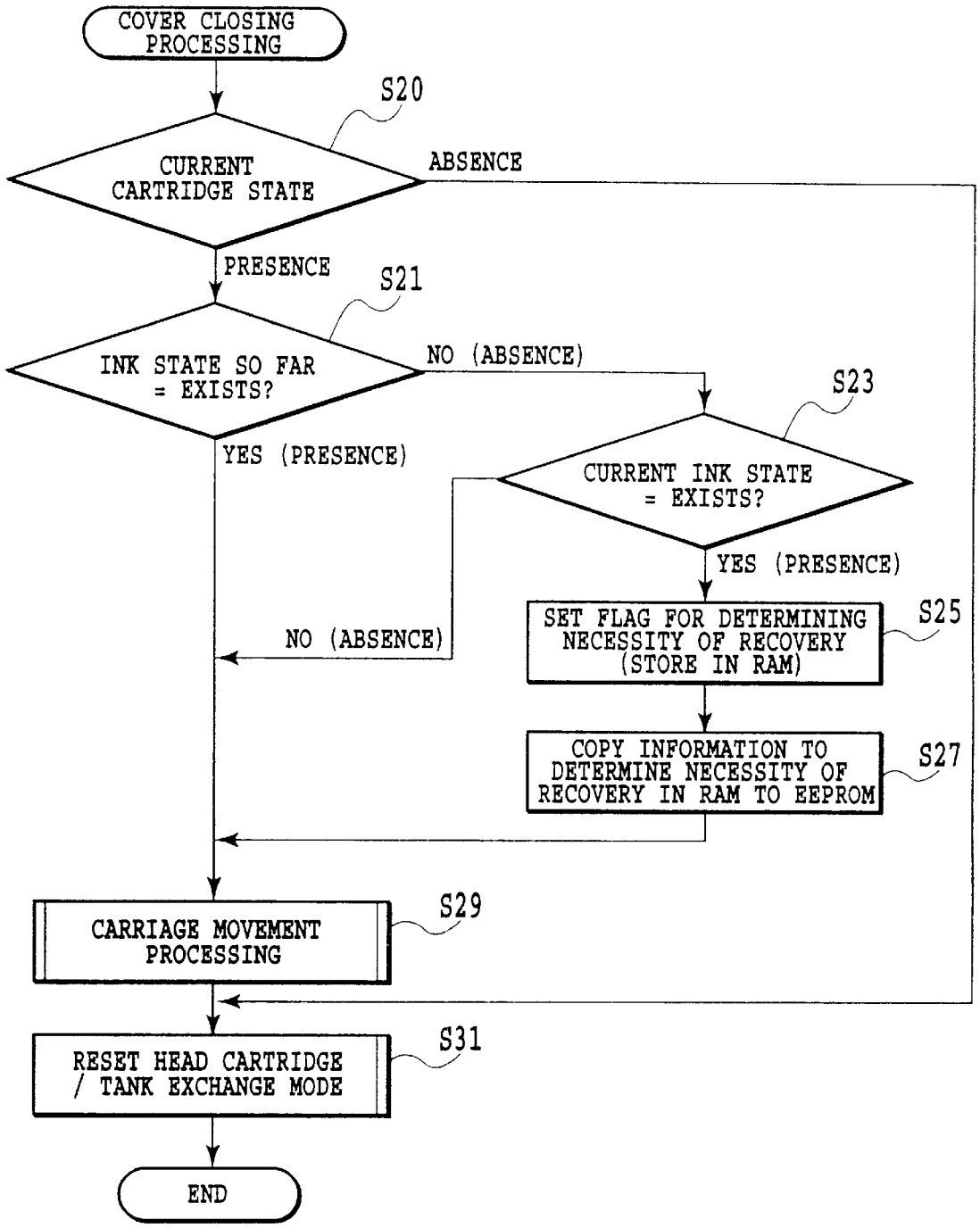
FIG. 7 is a flowchart showing an example of cover closing processing procedures activated when the front cover shown in FIGS. 1 and 2 is closed.

FIG. 7 shows an example of the cover closing processing procedure activated when the front cover 103 is closed.

In this procedure, first, the current attachment state of the head cartridge 201 is judged (Step S20). When the attachment is judged, the presence/absence state of ink in the oozing ink holding portion 202B which was judged in the front cover opening processing is checked (Step S21). If the absence state is judged, the current state of presence of ink in the oozing portion 202B is checked (Step S23). When the ink state in the oozing ink holding portion 202B is changed from "absence" to "presence", that is, it is judged that the ink tank has been exchanged, the flag 405C to determine necessity of recovery in the RAM 405 is set (Step S25) and this information is also stored in the EEPROM 407 (Step S27).

When the state of ink in the oozing ink holding portion 202B has already been judged as "presence" at the time the cover is opened, or when the state of ink in the oozing ink holding portion 202B is not changed between the time the cover was opened and the time it is closed and judged as "absence", the information to determine necessity of recovery in the RAM 405 is not renewed but remains as it is. Including the latter case, or including the case where the state is judged as "absence" after the cover is closed despite the fact that the state of ink in the oozing ink holding portion 202B was determined as "presence" at the time the cover was opened, when the current state of ink in the oozing ink holding portion 202B is judged as "absence", the user may be notified it in the subsequent processing and prompted to exchange the ink tank.

Next, the carriage 203 is moved from the head cartridge/ink tank exchange position to the print standby position (Step S29), and the head cartridge/ink tank exchange mode is finished by means of internal control (Step S31).

Also, even if the front cover 103 is closed without attachment of the head cartridge 201 and the attachment is not judged in Step S20, the program moves on to the Step S31, and the user may be notified of it in the subsequent processing and prompted for attachment.

In this example, in each processing from the front cover opening to closing, suction recovery operation is not executed even if the head cartridge or the ink tank is exchanged. The information to determine necessity of recovery is verified before paper feed operation for print and execution of recovery processing is determined.

FIG. 8 is a flowchart showing an example of control procedures at paper feed processing.

Figure 8A:
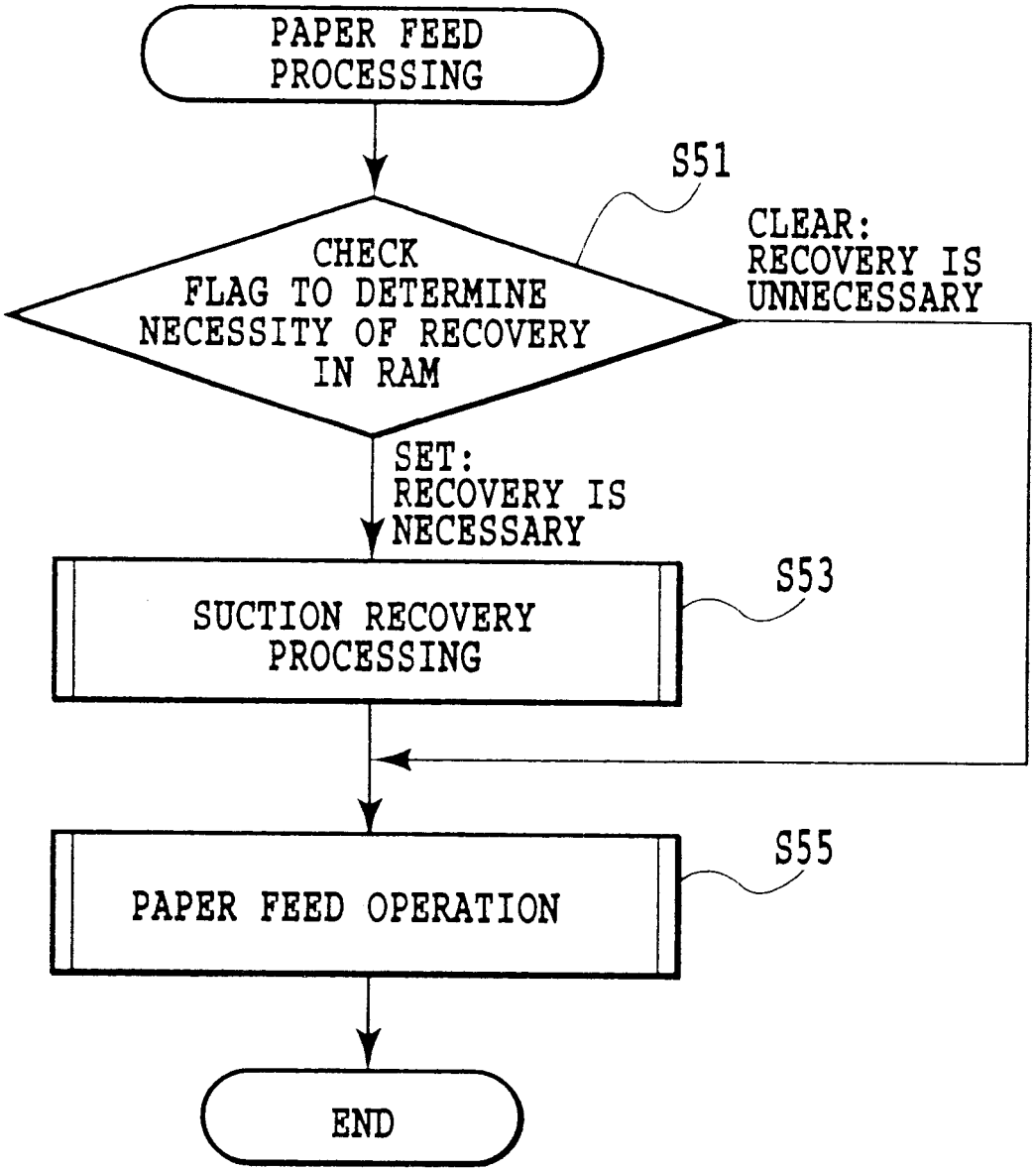
FIGS. 8A and 8B are flowcharts showing an example of control procedures at paper feed processing including recovery processing.
Figure 8B:
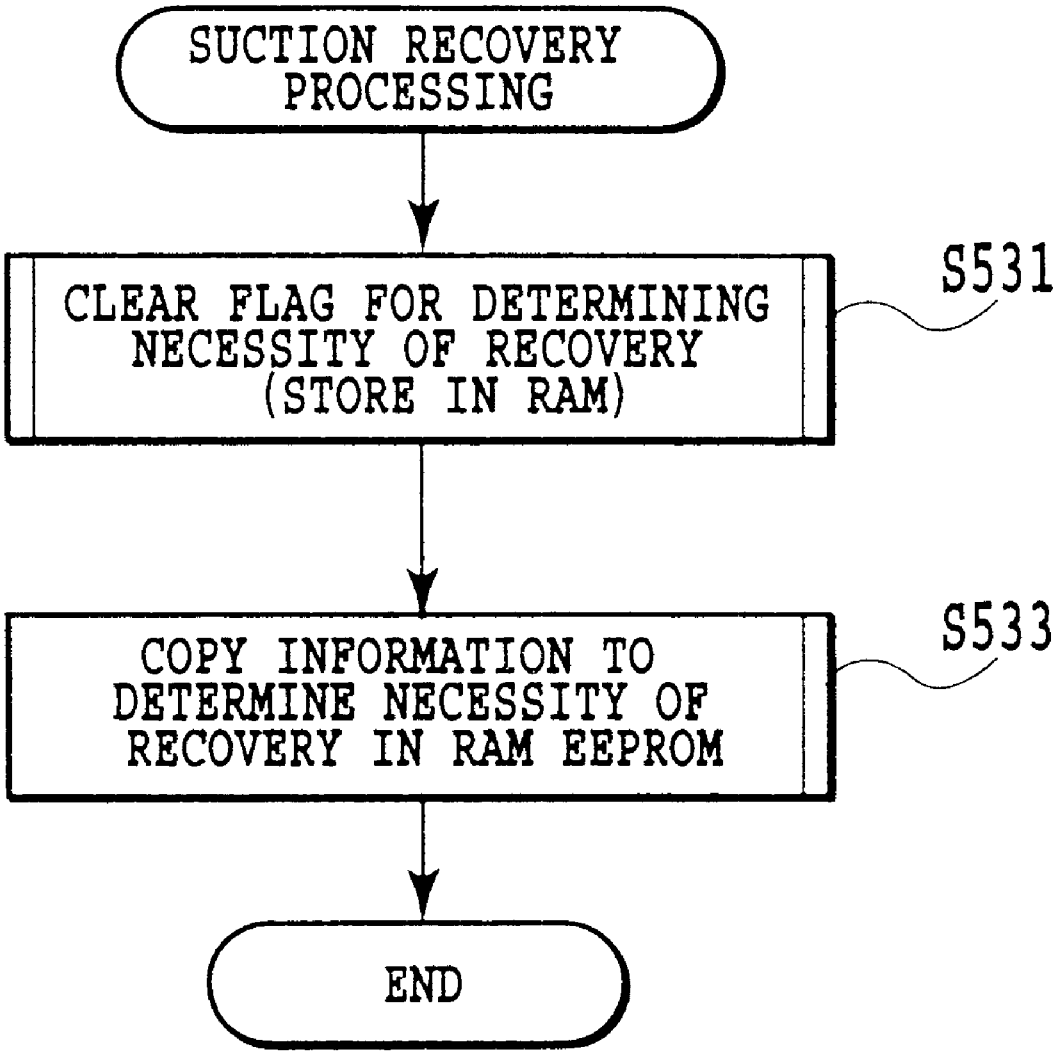

In this procedure, prior to the paper feed operation (Step S55) in FIG. 8A, the contents of the flag 407 for determining necessity of recovery in the RAM 405 is verified (Step S51), and when the flag is set, the suction recovery operation of the printing head is executed due to head cartridge/ink tank exchange (Step S53). Also, with this suction recovery processing, the flag for determining necessity of recovery in the RAM 405 is cleared (Step S531), and this information is stored also in the EEPROM 407 (Step S533) as shown in FIG. 8B. When the information to determine necessity of recovery has been cleared, the printing head suction recovery processing.

After the above recovery determination processing, paper feed is executed (Step S55), and the program moves to the print operation.

In this preferred embodiment, the reason why the information to determine necessity of recovery is stored in the EEPROM 407 as a non-volatile memory is as follows. That is because, where the information is stored only in the RAM 405 which is a memory whose contents is erased by hardware power supply OFF, the information to determine necessity of recovery is erased. Thus, despite that the fact the front cover 103 was opened before the hardware power supply was turned off last and at least either one of the head cartridge and the ink tank was exchanged, the suction operation before feed operation is not executed at the present time. Thus, the information to determine necessity of recovery is stored in the EEPROM 407 as the non-volatile memory at a predetermined timing.

Figure 9:
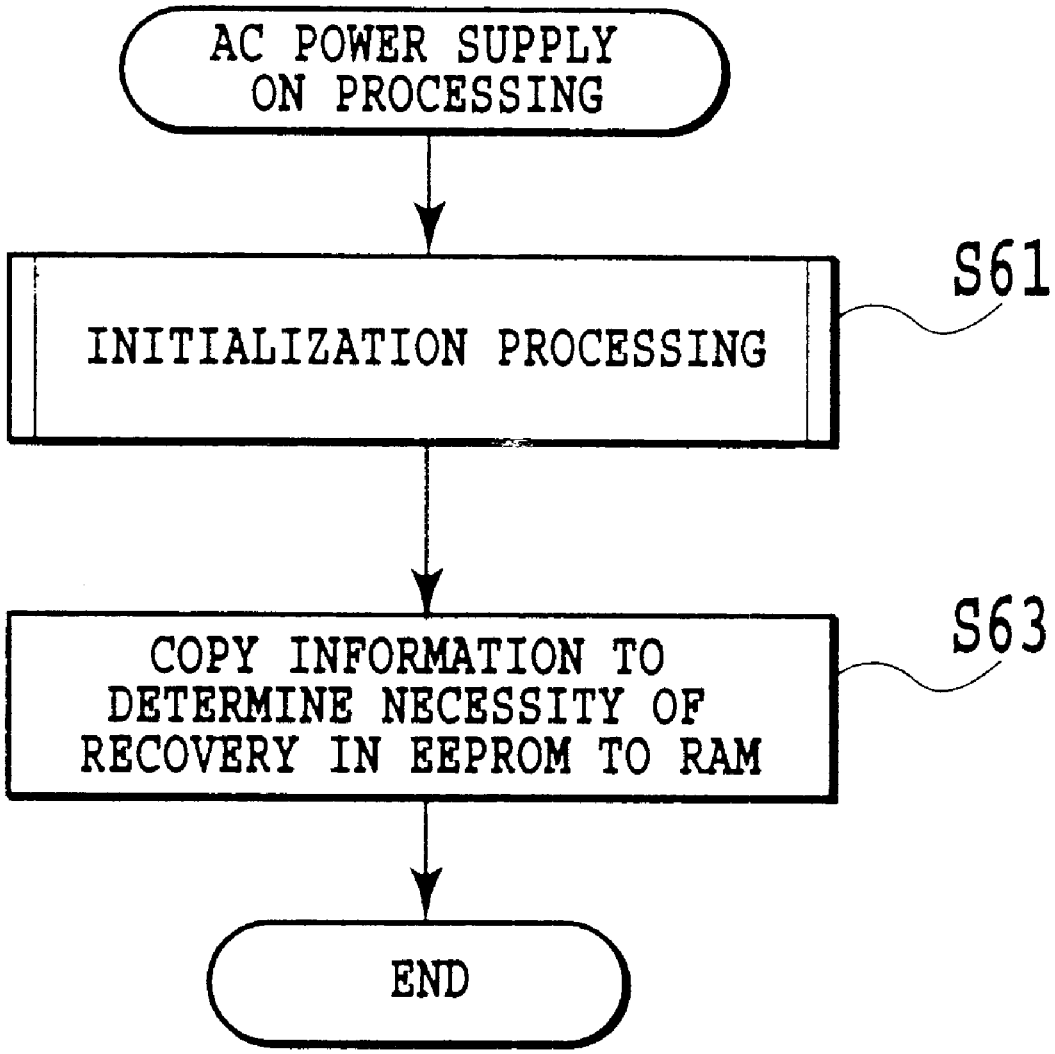

FIG. 9 is an example of the processing procedure executed when the primary power supply (AC power source) is turned on, that is, the hardware power supply is turned on by connecting the primary power-turn-on portion 10 to a power supply source or manipulating of the switch 10A. In this procedure, after initialization processing (Step S61) such as setting of hardware, the information to determine necessity of recovery held in the EEPROM 407 as the non-volatile memory is first copied as the information to determine necessity of recovery in the RAM 405 (Step S63). Then, using this information, necessity of recovery is judged prior to the paper feed operation.

According to the of the preferred embodiment described above, when it is judged that suction recovery of the printing head is necessary due to exchange of the printing head or the ink tank, this information is stored in the RAM and the EEPROM. Then, only before execution of the print operation, it is judged whether the suction recovery is necessary or not, if an affirmative judgment is made, the suction recovery operation is executed. At execution of the suction recovery, the above information is cleared to indicate that the suction recovery is unnecessary. Also, the above information is stored in the EEPROM and its contents are retained even after the apparatus power source (primary power supply) is off, and necessity of maintenance processing after the power supply is turned on can be judged based on the maintenance state of the printing head before the power supply was turned off. That is, the suction recovery processing is executed without waste at a proper timing and therefore, increase in ink consumption due to recovery processing of the inkjet head is effectively suppressed while maintaining ejection quality of the printing head.

(Others)

Incidentally, the present invention achieves distinct effect when applied to a print head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type inkjet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the print head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a print head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the print head, the present invention can achieve printing positively and effectively.

The present invention can be also applied to a so-called full-line type print head whose length equals the maximum length across a printing medium. Such a print head may consists of a plurality of print heads combined together, or one integrally arranged print head.

In addition, the present invention can be applied to various serial type print heads: a print head fixed to the main assembly of a printing apparatus; a conveniently replaceable chip type print head which, when loaded on the main assembly of a printing apparatus, is electrically connected to the main assembly, and is supplied with ink therefrom; and a cartridge type print head integrally including an ink reservoir.

It is further preferable to add a recovery system, or a preliminary auxiliary system for a print head as a constituent of the printing apparatus because they serve to make the effect of the present invention more reliable. Examples of the recovery system are a capping means and a cleaning means for the print head, and a pressure or suction means for the print head. Examples of the preliminary auxiliary system are a preliminary heating means utilizing electrothermal transducers or a combination of other heater elements and the electrothermal transducers, and means for carrying out preliminary ejection of ink independently of the ejection for printing. These systems are effective for reliable printing.

The number and type of print heads to be mounted on a printing apparatus can be also changed. For example, only one print head corresponding to a single color ink, or a plurality of print heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the inkjet system, the ink is generally temperature adjusted in a range of 30° C.-70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Further, the present invention can be applied to a print system as well as printing apparatus used as an image output terminal of an image data supply apparatus such as computers, scanners, digital cameras. A print system to which the present invention can be applied may be a print system comprising separate plural equipments (host computer, interface apparatus, scanner, printer, etc. for example) or a print system in which a plurality of apparatuses are integrated. The print system in which a plurality of apparatuses are integrated may be a copier integrated with a scanner and a printer, a facsimile machine integrated with a data transmitting/receiving apparatus and a printer, a word processor or electronic typewriter integrally having a printer, a digital camera integrated with a printer. When the present invention is applied to these print systems, at least one of means for turning on/off the secondary power supply, means for counting the number of times when the secondary power supply is turned on and means for maintaining the count value even in the state where the above primary power supply is turned off may be provided on a part other than the body of the printer.

As described in the foregoing, according to the present invention, by properly judging necessity of recovery processing, increase in ink consumption is effectively suppressed, while maintaining ejection quality of the inkjet head.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An inkjet printing apparatus for printing on a printing medium by using a printing head for ejecting ink, comprising:

recovery processing means for executing recovery processing for making an ink ejection state of the ink favorable;

memory means for storing information indicating whether execution of said recovery processing is necessary and for holding the stored information while the printing apparatus is powered off;

control means for causing said memory means to store the information that the recovery processing is necessary responsive to an exchange of at least one of the printing head and a member for retaining ink to be supplied to said printing head; and wherein said control means controls an execution of said recovery means prior to the start of a printing operation when the information indicating that said recovery processing is necessary is stored in said memory means.

2. An inkjet printing apparatus as claimed in claim 1, wherein said control means controls execution of said recovery processing before feeding of said printing medium prior to start of said printing operation.

3. An inkjet printing apparatus as claimed in claim 1, wherein information showing that said recovery processing is not necessary is written in said memory means, if said recovery processing is executed.

4. An inkjet printing apparatus as claimed in claim 1, further comprising holding means for holding contents thereof even in a state where the apparatus is powered off, and wherein said information is also written in said holding means.

5. An inkjet printing apparatus as claimed in claim 4, wherein said information written in said holding means is read out when the apparatus is powered on, and the read out information is written in said memory means.

6. An inkjet printing apparatus as claimed in claim 4, wherein said holding means has a non-volatile memory.

7. An inkjet printing apparatus as claimed in claim 1, further comprising detecting means for detecting a state of the ink stored in said member and wherein exchange of said member is judged based on change in the detected contents of said detecting means at start and end of a predetermined operation for said exchange.

8. An inkjet printing apparatus as claimed in claim 7, wherein said predetermined operation is an operation to open the inside of said apparatus.

9. An inkjet printing apparatus as claimed in claim 1, wherein it is determined that said exchange was executed based on a period of time required for the exchange which is set according to start of a predetermined operation for said exchange.

10. An inkjet printing apparatus as claimed in claim 9, wherein said predetermined operation is an operation to open the inside of said apparatus.

11. An inkjet printing apparatus as claimed in claim 1, wherein said recovery processing means has means for forcedly discharging the ink through an ejection opening of said printing head.

12. An inkjet printing apparatus as claimed in claim 11, wherein said means for forcedly discharging the ink includes means for suctioning the ink through said ejection opening.

13. An inkjet printing apparatus as claimed in claim 1, wherein said printing head has an electrothermal transducer to generate a thermal energy for causing film boiling in the ink as an energy used to eject the ink.

14. An inkjet printing apparatus according to claim 1, wherein said control means controls the execution of the recovering processing immediately prior to a start of the printing operation.

15. An inkjet printing apparatus according to claim 1, wherein said control means controls the execution of the recovery processing after a print command has been received to start the printing operation.

16. An inkjet printing apparatus according to claim 15, wherein said control means controls the execution of the recovery processing after the print command has been received and before feeding of the printing medium.

17. A printing system comprising a printing apparatus for performing printing on a printing medium by using a printing head and an image data supplying apparatus for supplying an image data to be printed to said printing apparatus, said printing apparatus having recovery processing means for making an ink ejection state of the ink favorable, said system comprising:

memory means for storing information indicating whether execution of the recovery processing is necessary and for holding the stored information while the printing apparatus is powered off; and control means for causing said memory means to store the information that the recovery processing is necessary responsive to an exchange of at least one of the printing head and a member for retaining ink to be supplied to said printing head; and wherein said control means controls an execution of said recovery means prior to the start of a printing operation when the information indicating that said recovery processing is necessary is stored in said memory means.

* * * * *